United States Patent [19]

Leblanc

[11] 4,401,083

[45] Aug. 30, 1983

[54] FUEL INJECTION PUMP FOR INTERNAL COMBUSTION ENGINES

[75] Inventor: Jean Leblanc, Lyons, France

[73] Assignee: Robert Bosch GmbH, Stuttgart, Fed. Rep. of Germany

[21] Appl. No.: 243,093

[22] Filed: Mar. 12, 1981

[30] Foreign Application Priority Data

Mar. 20, 1980 [DE] Fed. Rep. of Germany ..... 3010644

[51] Int. Cl.[3] ..... F02M 39/00; F02M 59/20

[52] U.S. Cl. ..... 123/449; 123/501

[58] Field of Search ..... 123/449, 450, 451, 501

[56] References Cited

U.S. PATENT DOCUMENTS

| | | | |
|---|---|---|---|
| 2,465,138 | 3/1949 | Van Tuyl | 123/450 |
| 3,091,231 | 5/1963 | Giraudon | 123/450 |
| 3,323,506 | 6/1967 | Pigeroulet et al. | 123/450 |
| 3,752,138 | 8/1973 | Gaines | 123/450 |
| 4,197,059 | 4/1980 | Simko | 123/501 |
| 4,200,072 | 4/1980 | Bailey | 123/450 |

FOREIGN PATENT DOCUMENTS

| | | | |
|---|---|---|---|
| 2268948 | 11/1975 | Fed. Rep. of Germany | 123/501 |
| 978362 | 12/1964 | United Kingdom | 123/501 |

*Primary Examiner*—Ira S. Lazarus
*Assistant Examiner*—Magdalen Moy
*Attorney, Agent, or Firm*—Edwin E. Greigg

[57] ABSTRACT

A distributor injection pump is proposed which has radial pistons disposed in a pump housing and a distributor which by axial displacement determines the injection quantity. The adjustment of injection onset is attained by the distributor being rotatable relative to the drive shaft; this relative rotation is attained via an intermediate coupling having a coupler ring adjustable by means of an intermediate rod actuated by a stroke device.

4 Claims, 2 Drawing Figures

FUEL INJECTION PUMP FOR INTERNAL COMBUSTION ENGINES

BACKGROUND OF THE INVENTION

The invention is based on a fuel injection pump for internal combustion engines. In a known fuel injection pump of this kind (see German Pat. No. 23 22 858), the injection onset adjustment is effected automatically in relation to the rpm level, so that with increasing rpm the injection onset is increasingly shifted to occur earlier. Engine manufacturers, however, increasingly require that the injection onset be adjustable independently of the rpm; in particular, it should be displaceable toward "early" when the engine is cold so that the fuel has sufficient time for good preparation.

OBJECT AND SUMMARY OF THE INVENTION

It is an object of the invention to provide a fuel injection pump according to the invention having the advantage over the prior art that a substantial improvement in fuel consumption and a reduction in the amount of toxic exhaust components can be attained by means of an adjustment in injection onset effected independently of the rpm.

It is a further object of the invention to provide that this adjustment may be effected in accordance with any engine characteristics desired by the manufacturer, such as load, temperature, and the like; on the other hand, the adjustment may also be effected arbitrarily.

The invention will be better understood and further objects and advantages thereof will become more apparent from the ensuing detailed description of a preferred embodiment taken in conjunction with the drawing.

BRIEF DESCRIPTION OF THE DRAWING

For the sake of clarity, the drawings are presented in simplified form, and show only those elements pertaining to the invention.

DESCRIPTION OF THE PREFERRED EMBODIMENT

Figure 1:
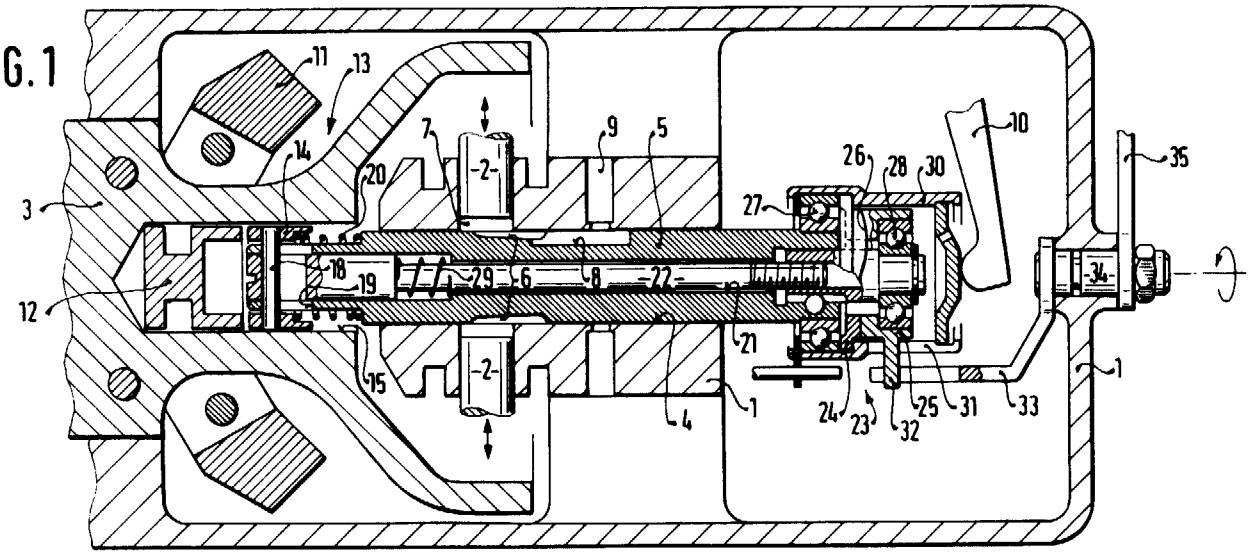
FIG. 1 illustrates in longitudinal section the fuel distributor with its equipment as well as parts of the housing surrounding the distributor.
Figure 2:
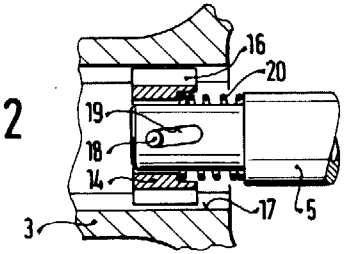
FIG. 2 shows the coupling for driving the distributor, but rotated by 90° from the position shown in FIG. 1.

In FIGS. 1 and 2, only those elements are shown which are required for explaining the invention. Considering FIG. 1, a pair of radially disposed pump pistons 2 are shown to operate within a housing 1 of a fuel injection pump, which pistons are set into reciprocating motion by a drive cam 3 and by a restoring force, not shown. The cam 3 is rigidly connected with the drive shaft of the injection pump. A distributor 5 is disposed such that it is both rotatable and axially displaceable within an inner bore 4 of the housing 1. On its jacket face, the distributor 5 is provided with grooves 6. During the inlet stroke (outward movement) of the pistons 2, the pump work chamber 7 is supplied with fuel via the grooves 6 and via conduits which are not shown. During the subsequent outlet stroke (inward movement on the part of the pistons), this fuel is then delivered via a distributor groove 8 to one or another of the pressure lines 9 which then lead to the individual fuel injection nozzles on the engine. The grooves 6 disposed on the jacket face take an appropriate course such that during an axial displacement of the distributor 5 they effect a change in the injection quantity in cooperation with relief bores, not shown; this is known from the prior art. The axial displacement is effected via a regulator lever 10, which serves to communicate to the pump the output of an rpm governor (not shown), rotational movement being provided to the distributor preferably arbitrarily by a counter force of the flyweights 11, which act via grippers (not shown) on an adjusting sleeve 12, which is engaged with the distributor 5 via the interposition of a coupling 13.

Referring now to FIG. 2, the coupling 13 is provided with a coupler ring 14, which is disposed in a central blind bore 15 of the cam cup 3, to which coupling rotary movement is supplied via elongated tangs 16 by means of longitudinal grooves 17 disposed in the bore 15. As best shown in FIG. 1, the distributor 5 is provided with rotary movement by the coupler ring 14 via a pin 18, to this end, oblong longitudinal recesses 19 are provided in the wall of the distributor 5. In operation, a displacement of the coupler ring 14 counter to the force of a restoring spring 20 causes a relative rotation of the distributor with respect to the drive cam 3 and accordingly causes an adjustment of injection onset, since the instant at which the grooves 6 open or close the relief bores is changed. The spring 20 is provided with sufficient tension during normal governor operation that it is not compressed, and thus no adjustment of injection onset will occur during normal operation. The sleeve 12, driven by the flyweights 11, acts to displace the coupler ring 14 together with the distributor 5 in the same manner as though all elements were positively associated as a rigid system.

The displacement of the pin 18 in the longitudinal groove 19 is effected by a coupler rod 22 disposed in a central bore 21 in the distributor 5 and mounted, on an extremity remote from the pin 18, in a stroke device 23. This stroke device 23 comprises two rings 24 and 25, whose opposed end faces are provided with complementary protrusions and depressions 26. When the rings 24 and 25 rotate relative to one another, the protrusions and depressions 26 are shifted to non-complementary disposition thus causing a change in the relative axial position thereof; in other words, there is a change in the stroke. While the ring 24 is connected with the distributor 5 via a ball bearing 27, the ring 25 is connected via a ball bearing 28 with the coupler rod 22. As a result, it is possible for the two stroke rings 24, 25 to remain at rest while the coupler rod 22 and the distributor 5 rotate, or alternatively for the first stroke ring 25 to be rotatable relative to the other stroke ring 24. A form lock between the surfaces 26 is attained by means of a spring 29 which is disposed between the distributor 5 and the coupler rod 22. In order to achieve the independent operation of the governor and the injection adjuster, a sleeve 30 is disposed about the rings and the associated ball bearings. The sleeve 30 is firmly connected with the ball bearing 27 of the distributor 5 and is provided with a lateral recess 31 through which a rotation lever 32 on the ring 25 protrudes, the rotation lever 32 being connected with the coupler rod 22. Upon the rotation of the ring 25 caused by this lever 32, the coupler rod 22 varies its axial relationship with the distributor 5 because of the surfaces 26; the pin 18 of the coupling 13 is also displaced within the oblong longitudinal recesses 19, thus changing the relative rotary position of the distributor 5 with respect to the drive cam 3.

The coupling of the lever 32 is effected via an adjusting lever 33, which is supported on a bolt 34 in the housing 1 and is rotatable from outside of the housing by means of a lever 35. The lever 35 may be adjusted manually either in accordance with engine characteristics or arbitrarily.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection pump for internal combustion engines having: means to adjust injection onset; and further means to control an injection quantity, including:

a rotatably and axially displaceable distributor having a jacket face;

a pump drive shaft;

a coupling connected to the distributor and the pump drive shaft; wherein said pump drive shaft drives said distributor through said coupling;

said further means to control an injection quantity comprising grooves provided in the jacket face of said distributor;

said means to adjust injection onset including: the coupling, guide means disposed in said drive shaft and a coupler ring, whereby relative rotation of said distributor with respect to said drive shaft can be effected, the improvement comprising:

the distributor having a central bore, a coupler rod received in said bore and cooperating with said coupler ring to displace the latter independently of axial movement of said distributor;

and a stroke device connected to said coupler rod to displace the latter relative to the distributor whereby the injection onset may be adjusted independently of drive shaft rpm, said stroke device including two rings having axially opposed surfaces, a first ring having protrusions and a second ring having depressions, said first ring being connected with the distributor and said second ring being connected with the coupler rod.

2. In a fuel injection pump as defined by claim 1, wherein an axial bearing is associated with each of said two rings, the axial bearing of said first ring serving to uncouple said ring from the distributor, and the axial bearing of said second ring serving to uncouple said ring from said coupler rod, whereby the rings will not rotate with the bearings, and a distributor ring is disposed on said distributor for displacement therewith solely in axial direction, said distributor ring and said distributor forming said means for controlling injection quantity, and said second ring is rotatable relative to said first ring.

3. In a fuel injection pump as defined by claim 2, wherein a sleeve is connected with the first ring, and said second ring is rotatably disposed for axial displacement in said sleeve, said second ring being provided with means to render it rotatable relative to said sleeve from outside said sleeve.

4. In a fuel injection pump as defined by claim 3, wherein a lever arm comprises said means provided on said second ring, said sleeve being provided with an aperture through which said lever arm projects radially outward.

* * * * *